US011376856B2

(12) United States Patent
Forcada Pardo et al.

(10) Patent No.: US 11,376,856 B2
(45) Date of Patent: Jul. 5, 2022

(54) PRINTING SYSTEM AND CARTRIDGE FOR A PRINTING SYSTEM

(71) Applicant: Hewlett-Packard Development Company, L.P., Spring, TX (US)

(72) Inventors: Santiago Forcada Pardo, Sant Cugat del Valles (ES); Alejandro Mielgo Barba, Sant Cugat del Valles (ES); Jeffrey Thielman, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/262,255

(22) PCT Filed: Dec. 7, 2018

(86) PCT No.: PCT/US2018/064551
§ 371 (c)(1),
(2) Date: Jan. 22, 2021

(87) PCT Pub. No.: WO2020/117272
PCT Pub. Date: Jun. 11, 2020

(65) Prior Publication Data

US 2021/0347177 A1 Nov. 11, 2021

(51) Int. Cl.
*B41J 2/175* (2006.01)
*B41J 2/17* (2006.01)
*B41J 2/165* (2006.01)

(52) U.S. Cl.
CPC ..... *B41J 2/1721* (2013.01); *B41J 2/16523* (2013.01); *B41J 2/17566* (2013.01)

(58) Field of Classification Search
CPC ... B41J 2/1721; B41J 2/16523; B41J 2/17566
See application file for complete search history.

(56) References Cited

U.S. PATENT DOCUMENTS

| | | | | |
|---|---|---|---|---|
| 5,774,142 | A | 6/1998 | Nguyen et al. | |
| 6,249,655 | B1 | 6/2001 | Baek et al. | |
| 6,357,854 | B1 | 3/2002 | Igval et al. | |
| 6,505,009 | B2 | 1/2003 | Henricus et al. | |
| 6,733,108 | B2 | 5/2004 | Barton et al. | |
| 6,834,931 | B2 | 12/2004 | Ang et al. | |
| 7,188,939 | B1 | 3/2007 | Sasaki | |
| 7,931,350 | B2 | 4/2011 | Furukawa et al. | |
| 2004/0075712 | A1* | 4/2004 | Ono | B41J 2/1721 347/36 |
| 2006/0061620 | A1* | 3/2006 | Tani | B41J 2/1721 347/36 |

(Continued)

FOREIGN PATENT DOCUMENTS

| | | |
|---|---|---|
| EP | 2298556 | 3/2011 |
| EP | 2433802 | 3/2012 |

*Primary Examiner* — Sharon Polk
(74) *Attorney, Agent, or Firm* — HP Inc. Patent Department

(57) ABSTRACT

A cartridge for a printing system comprises a receptacle to receive waste printing material from the printing system, a floater to change its position based on a varying filling level of the waste printing material in the receptacle, and a flag mechanically coupled to the floater, wherein a position of the flag depends on the position of the floater and indicates, outside of the receptacle, the filling level.

20 Claims, 8 Drawing Sheets

(56) References Cited

U.S. PATENT DOCUMENTS

| | | | | |
|---|---|---|---|---|
| 2009/0066749 | A1 | 3/2009 | Young et al. | |
| 2009/0251510 | A1* | 10/2009 | Noro | B41J 2/1721 347/84 |
| 2016/0279961 | A1 | 9/2016 | Nukui et al. | |

* cited by examiner

PRINTING SYSTEM AND CARTRIDGE FOR A PRINTING SYSTEM

BACKGROUND

Printing systems may use a cartridge that provides for a printing material, for example a liquid. The cartridge may provide printing material such as ink and/or may host further or alternative systems.

BRIEF DESCRIPTION OF THE DRAWINGS

Examples will now be described, by way of a non-limiting example only, with reference to the accompanying drawings, in which.

DETAILED DESCRIPTION

Figure 1B:
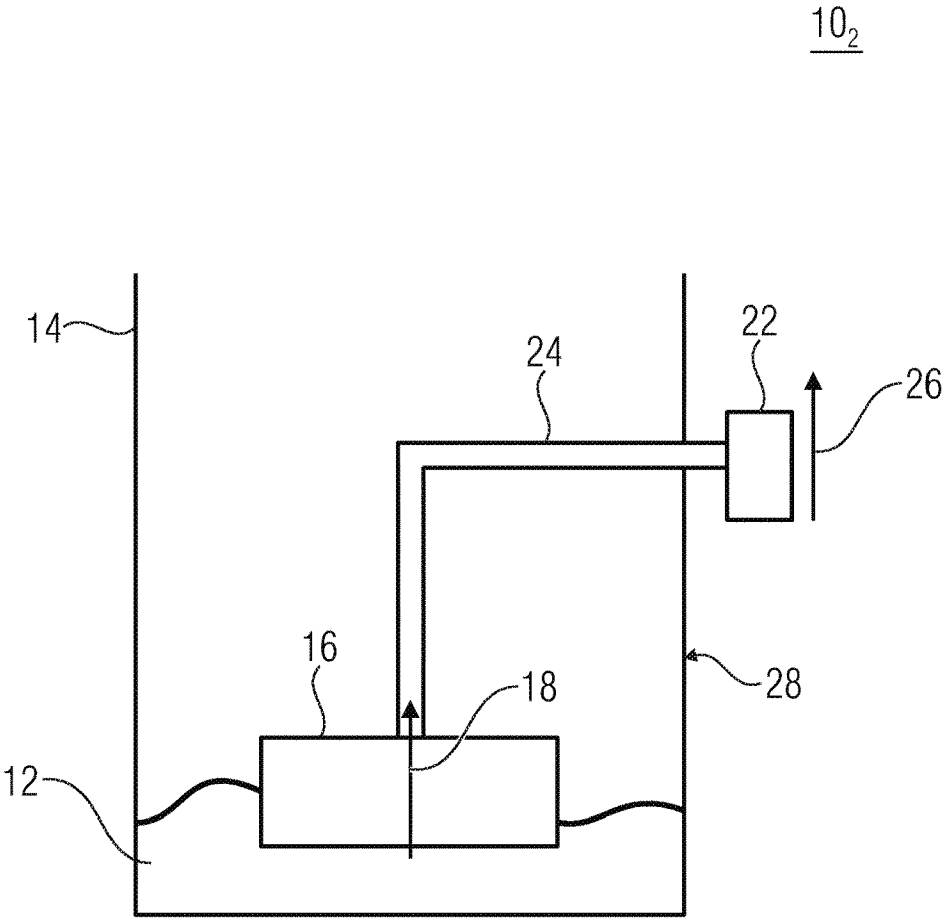
FIG. 1*b* shows a schematic side view of a cartridge according to an example having a mechanical element formed as an angled or a multiple angled element.

Equal or equivalent elements or elements with equal or equivalent functionality are denoted in the following description by equal or equivalent reference numerals even if occurring in different figures.

In the following description, a plurality of details is set forth to provide a more thorough explanation of examples of the present disclosure. However, examples of the present disclosure may be practiced without these specific details. In other instances, well-known structures and devices are shown in block diagram form rather than in detail in order to avoid obscuring examples of the present disclosure. In addition, features of the different examples described hereinafter may be combined with each other, unless specifically noted otherwise.

Examples described herein relate to collecting a waste printing material, i.e., material that is provided in excess when compared to printing material that is actually printed by the printing system. Although the examples described herein relate to a cartridge and a printing system that may use ink to be printed, the concept of collecting waste printing material and to indicate a filling level of a container or volume for collecting the waste printing material, i.e., a receptacle, may be used or transferred, without limitation, to receptacles for collecting any type of wet liquid printing material.

An example for collecting waste printing material is executed in a spittoon subsystem of a printing system that accumulates waste. Examples herein provide for a concept to provide for information indicating the level of the waste printing material so as to avoid leakage of the waste printing material out of the receptacle. Such waste printing material may have its origin from missing drops caused, for example, by the clogging of nozzles in a printhead (PH) of a printing system, or a bad final position of the drop of ink onto a print target due to a misdirected firing. A print target may be a 2D media, e.g., a flat sheet, but may also be a substrate, bed or base onto which a 3D structure is printed using build material.

Figure 1A:
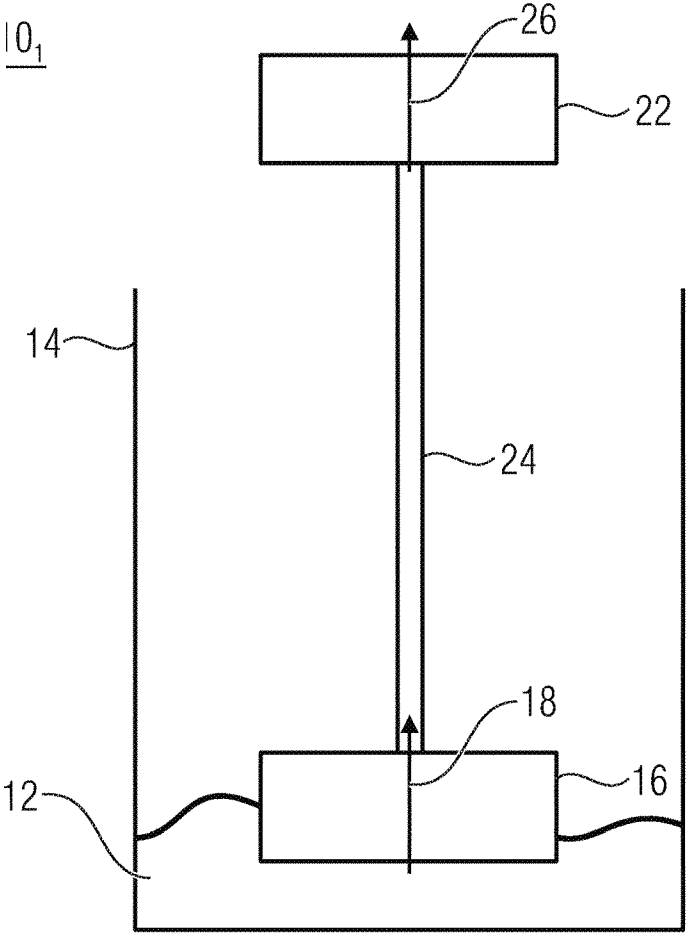
FIG. 1*a* shows a schematic side view of a cartridge according to an example.

FIG. 1*a* shows a schematic side view of a cartridge $\mathbf{10}_1$ according to an example. The cartridge $\mathbf{10}_1$ a may be used in a printing system, for example, an inkjet printing system. By way of example, the cartridge may be part of a spittoon subsystem of the printing system to accumulate waste printing material 12 in a waste volume, container or receptacle 14. That is, the receptacle 14 may receive the waste printing material 12 from the printing system. Inside the waste volume, container or receptacle 14 the cartridge may collect the waste printing material 12 so as to accumulate an amount thereof over time. The cartridge $\mathbf{10}_1$ may be referred to as a printhead cleaning cartridge.

The receptacle 14 may be integrally formed with the cartridge $\mathbf{10}_1$ or a main body or a substrate thereof. The receptacle 14 provide for a volume to receive, collect a store the waste printing material 12. The receptacle 14, wall structures thereof respectively may comprise a solid material such as a plastic material, a metal material or the like. The wall structures may limit the receptacle 14 at sides, a bottom and/or a top of the volume. An opening in a wall structure and/or an at least partially missing wall structure, e.g., an at least partially missing top wall such as a lid or cap, may provide for an inlet of the waste printing material 12 into the receptacle 14, wherein the waste printing material may be received under pressure or pressure-less.

The cartridge $\mathbf{10}_1$ comprises a floater 16 that may float or drift on or in the waste printing material 12. The floater 16 may comprise material and/or a relative overall density that is below a density of the waste printing material 12 so as to allow a floating or drifting of the floater 16 on or in the waste printing material. For example, the floater 16 may comprise a plastic material. Alternatively or in addition, the floater may be formed as a hollow body.

An example printing system is an inkjet printer, wherein the waste printing material 12 may be a liquid. According to examples, the printing system is a 2D or 3D printing system and may alternatively or in addition to the liquid print a dry or powdered printing material such that the receptacle may also contain such a dry or powdered or liquidized powdered material. Alternatively or in addition, the condition of the waste printing material may vary over time. For example, the waste printing material may be put into the receptacle 14 as liquid ink. Over time, a portion of the waste printing material 12 such as water and/or other solvents may evaporate such that the waste printing material 12 becomes more solid like. The waste printing material 12 may thus get into a state being referred to as dried out liquid material.

The floater 16 may change its position based on a varying filling level of the waste printing material 12 in the receptacle 14. For example, with an increase in the filling level a surface of the waste printing material 12 and thereby of the floater 16 may travel towards a positive filling direction 18.

The cartridge $\mathbf{10}_1$ may comprise a flag 22 being mechanically coupled to the floater 16. The flag 22 may be coupled to the floater 16 directly or indirectly, e.g., via a mechanical element 24, such as a rigid body or a set thereof so as to induce a movement of the flag 22 responsive to a movement of the floater 16. A position of the flag 22 may thus depend on the position of the floater 16. The position of the flag 22 may indicate the filling level of the waste printing material 12 outside the receptacle 14. A direction 26 of the movement of the flag 22 may be in parallel with the filling direction 18 but may also be directed towards a different direction.

According to an example, the flag 22 may protrude or project or stick out of the receptacle 14 on a top side of the receptacle 14. According to examples, at varying filling levels of the waste printing material 12, the flag 22 may protrude with a constant, or alternatively, varying size or dimension at a side of the receptacle 14, the cartridge respectively. The flag may thus move based on the filling level, the movement and/or resulting position indicating a variation in the filling level.

The flag 22 may have any shape or geometry and may serve as an indicator to be detected by the naked eye and/or by a sensor element. The position of the flag 22 indicating the filling level of the waste printing material 12 in the receptacle 14 may refer to a position of the flag 22, but may also refer to a visible size of the flag 22.

The flag 22 may be of any material, for example, a metallic material such as copper, iron, steel or aluminum and/or may comprise a plastic material and/or a semiconductor material and/or a fiber material such as paper, wood or fiber reinforced plastic.

FIG. 1*b* shows a schematic side view of a cartridge $\mathbf{10}_2$ according to an example. The explanation given in FIG. 1*a* also applies to FIG. 1*b*, wherein the mechanical element 24 may be formed as an angled or a multiple angled element such that the flag 22 is arranged aside an axis of movement of the floater 16. For example, the flag 22 may protrude, extend outwards or stick out from the receptacle 14 at a side surface 28 of the receptacle 14, i.e., at a side that is variably covered with waste printing material 12.

Figure 1D:
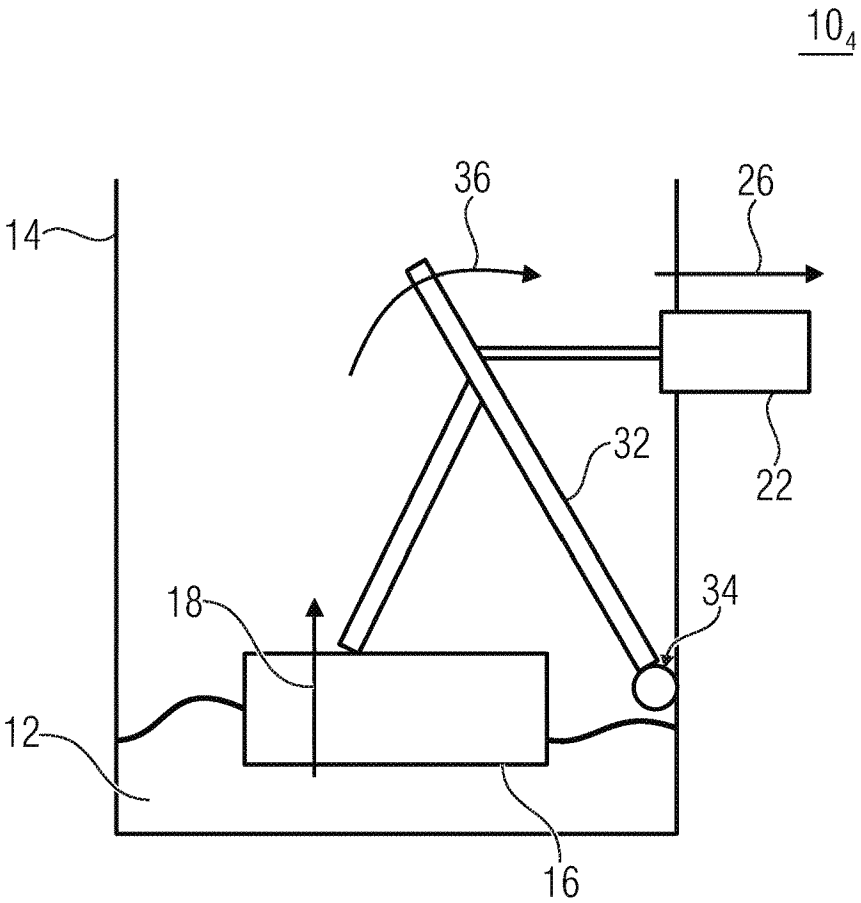
FIG. 1*d* shows a schematic side view of a cartridge having a lever element that is hinged at the cartridge.
Figure 1C:
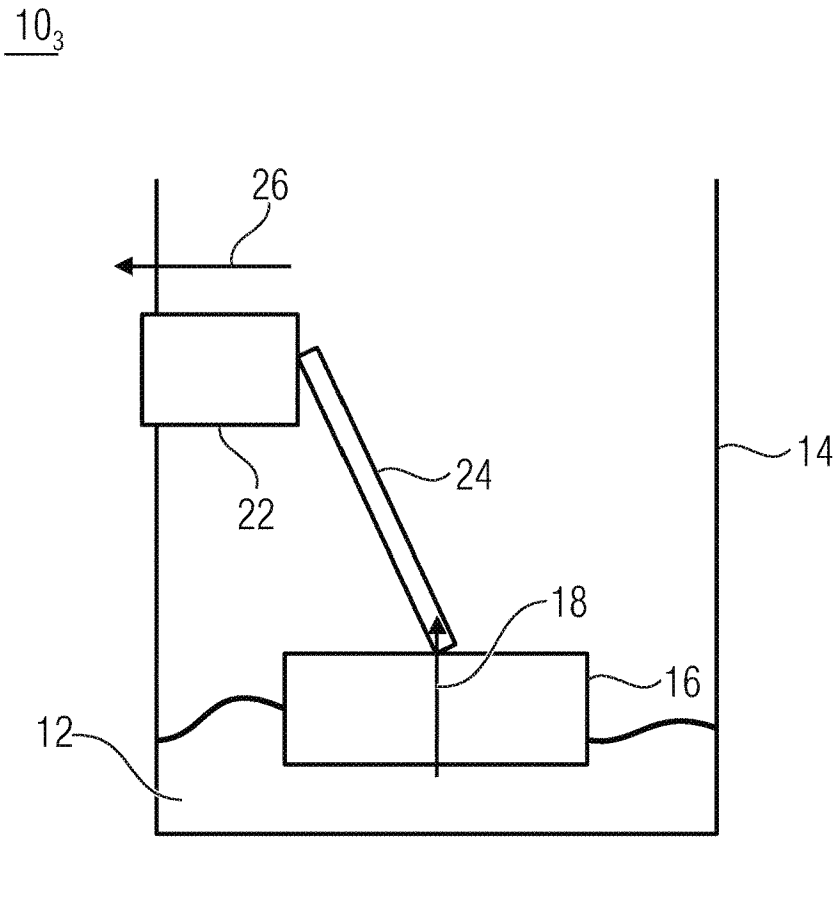
FIG. 1*c* shows a schematic side view of a cartridge according to an example, wherein a floater moves along the filling direction and a connected flag may move accordingly in the direction of movement.

FIG. 1*c* shows a schematic side view of a cartridge $\mathbf{10}_3$ according to an example. While the floater 16 moves along the filling direction 18, the flag may move accordingly in the direction of movement 26. The direction of movement 26 may be same or parallel to the filling direction but may also be changed or converted into any other direction such that the direction of movement 26 is different from the filling direction 18. For example, a side wall of the receptacle 14 and/or of the cartridge $\mathbf{10}_3$ may comprise guiding allowing to convert the movement of the floater 16 in the different direction, for example, a perpendicular direction or having at least a component of movement being perpendicular to the direction 18.

Alternatively or in addition, the flag 22 may protrude or stick out of the receptacle 14 with a varying size based on the filling level. For example, with an increase in the filling level, i.e., a movement of the floater 16 along the direction 18, an increasing size of the flag 22 may protrude out of the receptacle 14 and/or of the cartridge $\mathbf{10}_3$ such that the size being visible outside the receptacle 14, the cartridge $\mathbf{10}_3$ may be evaluated and/or indicate the filling level.

FIG. 1*d* shows a schematic side view of a cartridge $\mathbf{10}_4$ having a lever element that is hinged at the cartridge $\mathbf{10}_4$, e.g., at the receptacle 14 at a bearing region 34 such that at least a portion of the lever element 32 is rotatably movable along a rotational direction 36. The flag 22 and the floater 16 are mechanically coupled to each other via the lever element 32, i.e., the flag 22 and the floater 16 may both be connected to the lever element 32, directly or indirectly. The lever element 32 or a plurality of lever elements may convert a movement of the floater 16 along the filling direction 18 into a movement of the flag 22 along the direction 26 of movement that is different when compared to the direction 18.

As described in connection with FIG. 1*c*, the size of the flag 22 visible outside the receptacle 14 or the cartridge $\mathbf{10}_4$ may vary based on the filling level so as to allow an estimation or determination of the filling level.

Although the cartridges $\mathbf{10}_1$, $\mathbf{10}_2$, $\mathbf{10}_3$ and $\mathbf{10}_4$ are described as to show for an increase in height and/or size of the flag 22 outside of the receptacle 14 and/or the cartridge with an increase of the filling level, according to an example, a mechanism may be arranged so as to invert the movement of the flag 22. That is, a visible or evaluable size of the flag 22 may decrease with an increase of the filling level. For example, a lever mechanism may be arranged.

As shown, a position outside of the receptacle 14, the cartridge respectively, e.g., a presence or absence at an evaluated region and/or a visible or evaluable size of the flag 22 may indicate a magnitude or amount of the filling level.

Figure 2A:
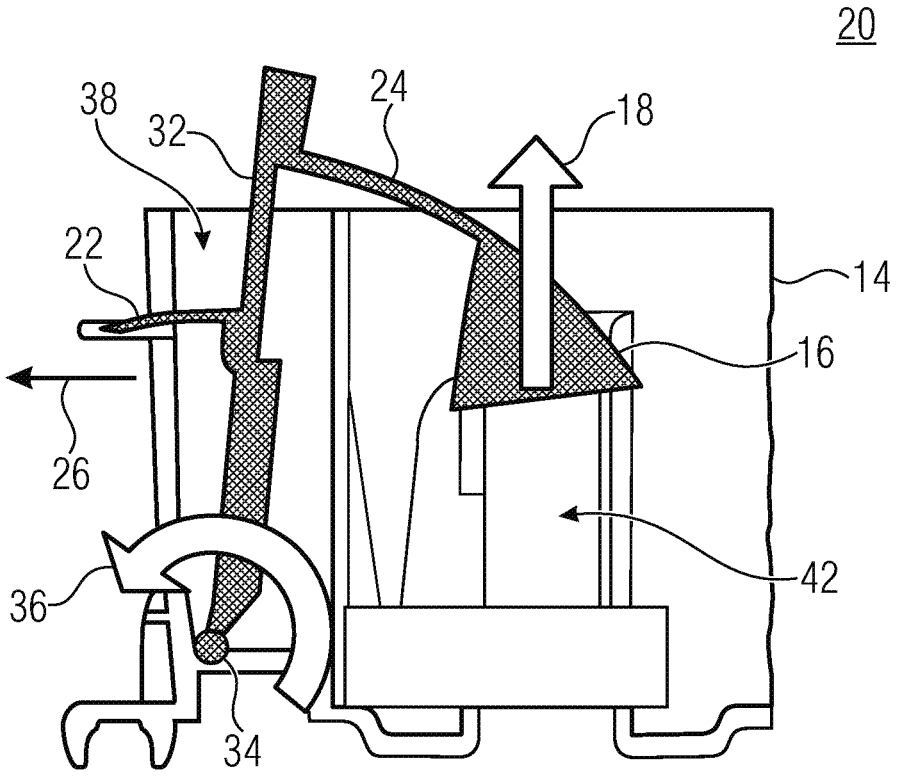
FIG. 2*a* shows a schematic side view of a cartridge in accordance with an example, comprising the receptacle to receive the waste printing material and a further volume beside the receptacle.

FIG. 2*a* shows a schematic side view of a cartridge 20 in accordance with an example. The cartridge 20 comprises the receptacle 14 to receive the waste printing material and may comprise a further volume 38 beside the receptacle 14. The further volume 38 may host the bearing region 34 and/or the lever element 32 to which the floater 16 is connected via the mechanical element 24. Additionally, the flag 22 may, directly or indirectly, be mechanically coupled to the lever element 32. The movement of the floater 16 along the filling direction 18 may be supported by use of a mechanical guidance to guide the floater 16 such that a movement of the floater 16 along the directions different from the filling direction 18 are hampered or prevented.

Rotating of the lever element 32 at the bearing region 34 along the rotational direction 36 may allow the flag 22 to increasingly stick out of the cartridge 20 with an increase or decrease of the filling level so as to indicate the filling level present inside the receptacle 14 to an outside thereof thereby enabling an evaluation or monitoring of the filling level outside the receptacle and thereby allowing for a timely change or evacuation of the receptacle to prevent an overflow of the receptacle 14.

When compared to FIG. 1*d*, the bearing region 34 may be outside the receptacle 14 but inside the cartridge 20. Arranging the bearing region 34 outside of the receptacle 14 may allow to prevent a contact of the bearing with the waste material and may thus prevent drying of the waste material and/or a hampering of the rotational movement of the lever element 32.

Figure 2B:
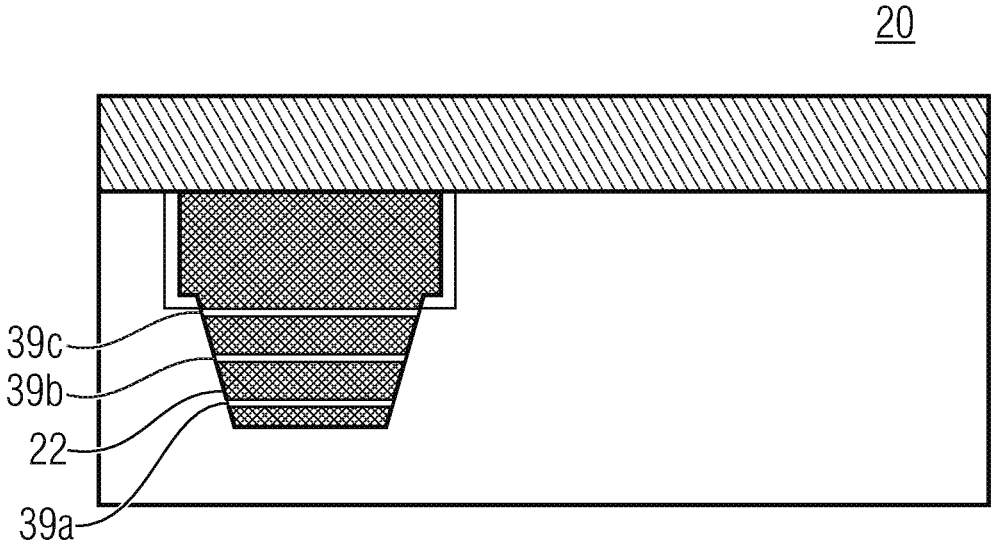
FIG. 2*b* shows a schematic top view of the cartridge 20 of FIG. 2*a*. Different lengths of the flag 22 protruding out of the cartridge 20 and/or the receptacle 14 indicate different degrees of filling in the receptacle 14

FIG. 2*b* shows a schematic top view of the cartridge 20 of FIG. 2*a*. Different lengths of the flag 22 protruding out of the cartridge 20 and/or the receptacle 14 indicate different degrees of filling in the receptacle 14. The flag 22 may have a conical shape and may be flat along a direction perpendicular to a height direction parallel to the filling direction 18. Alternatively, the flag 22 may have any other shape and may, in particular, be non-flat or perpendicular to the height direction. As with a varying degree of filling in the receptacle 14 a varying size or amount of the flag 22 is associated, the visible size of the flag 22 directly indicates the filling level. The flag 22 may comprise a coding, e.g., different colors and/or a varying labeling, thereby indicating the degree of filling in a further way. For example, a red color visible outside of the cartridge 20 may indicate an information according to "receptacle is full".

Such information may alternatively or in addition encoded by optical or mechanical structures 39*a* to 39*c* acting on a motor, e.g., lines, circles, triangles or the like. A number of structures 39*a* to 39*c* that has passed the motor or is visible may indicate a longer or shorter length and thus a fuller container.

Figure 3A:
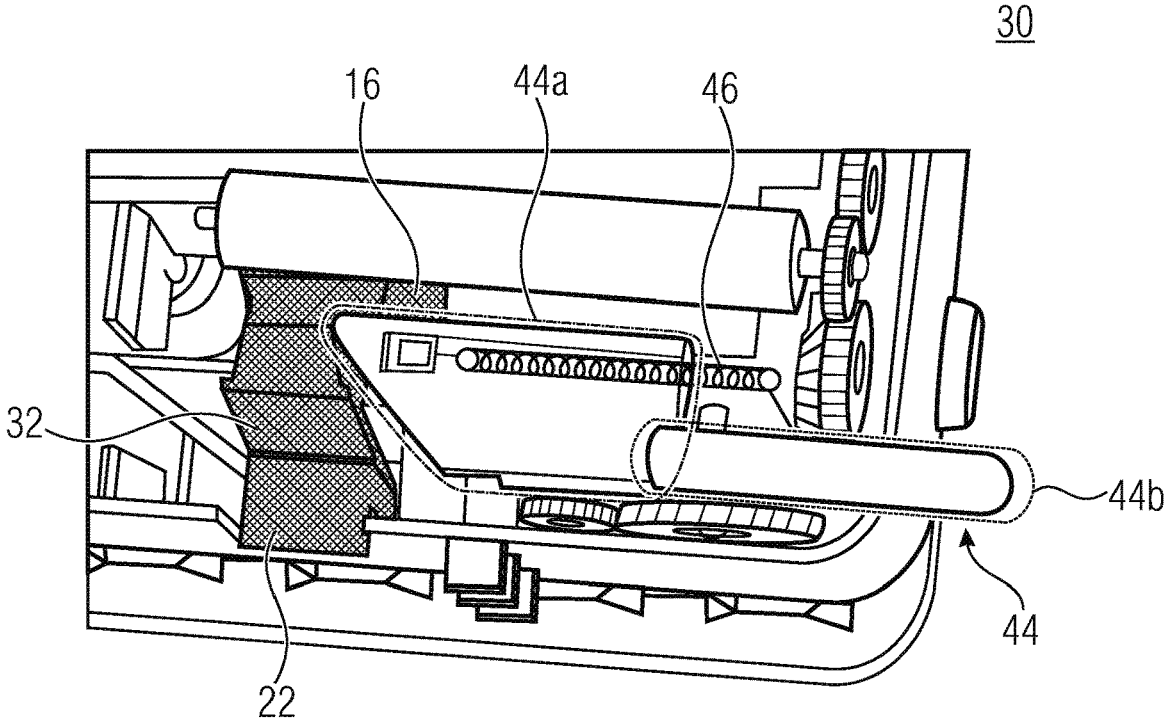
FIG. 3*a* shows a schematic top view on a cartridge in accordance with an example, comprising a mechanical actuator which may mechanically change a position of the floater artificially.

FIG. 3*a* shows a schematic top view on a cartridge 30 in accordance with an example. The cartridge 30 comprises a mechanical actuator 44 which may mechanically change a position of the floater 16 artificially, i.e., when compared to a position of the floater 16 that is obtained based on a floating thereof on or in the waste printing material 12, the mechanical actuator 44 may force the floater 16 temporarily to a different position. This allows to prevent crusting or sticking of the floater 16 and/or of flag 22 to a fixed position, for example, when the waste printing material dries out. That is, the mechanical actuator 44 is to intermittently mechanically engaging with the floater 16 or an element mechanically coupled thereto such as the lever element 32, the mechanical element 24 and/or the flag 22.

A first portion 44*a* of the mechanical actuator 44 may provide for the mechanical contact to the respective portion of the indicator arrangement comprising the floater 16, the flag 22 and mechanical elements arranged therebetween or attached hereto. A second portion 44*b* may at least partially stick out of the cartridge 30 in a reference position that may be obtained, for example, by use of a spring element 46. The second portion 44*b*, the portion thereof sticking out of the cartridge respectively, may intermittently mechanically engage with a static portion of a printing system into which the cartridge 30 is mounted. The static portion may be a wall of the printing system, or any other portion thereof that allows for an impact of the second portion 44*b*. By mechanically engaging with the static portion, the mechanical actuator may move relative to the cartridge 30, thereby mechanically engaging with the indicator arrangement at the first portion 44*a*. Additionally, the spring element 46 may be charged or stressed or enlarged so as to store energy. As soon as the cartridge 30 leaves this position, e.g., a homing position of the cartridge 30, the charged spring element 46 may lead the mechanical actuator 44 to disengage with the indicator arrangement and to reposition the second portion 44*b* outside of the cartridge 30. After having disengaged the indicator arrangement, the mechanical actuator may keep in the position of the floater unchanged with respect to the floating position.

Figure 3B:
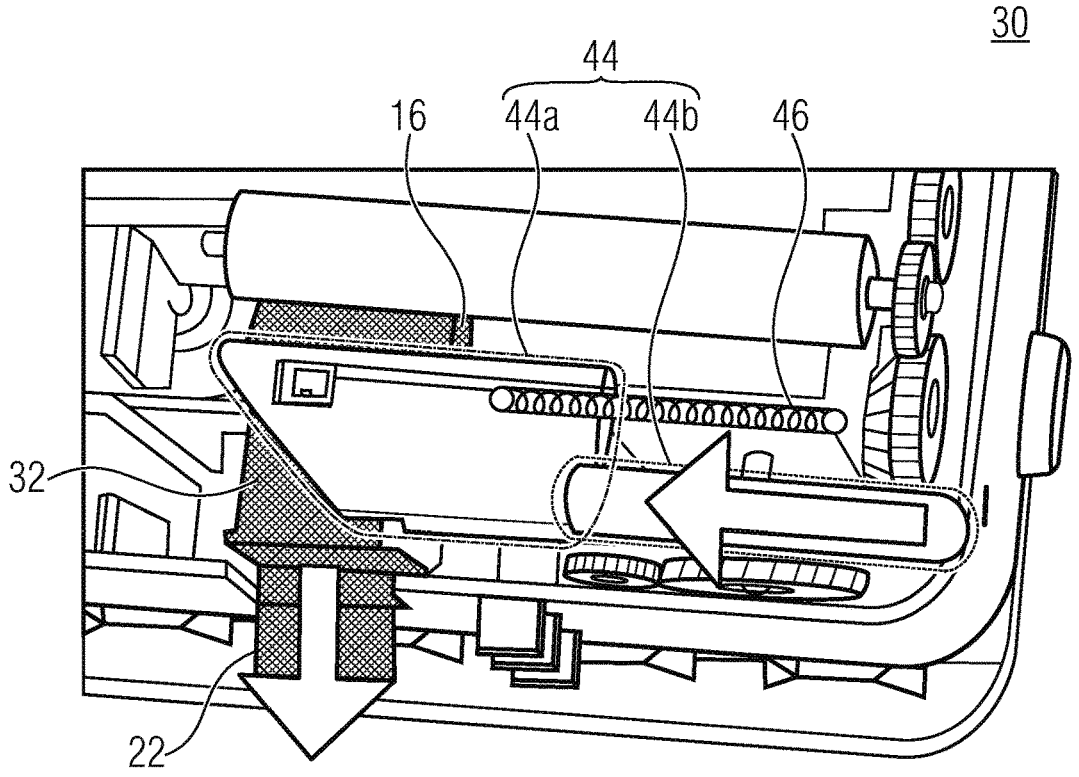
FIG. 3*b* shows a schematic top view on the cartridge of FIG. 3*a* according to an example in which wherein the position of the floater is artificially moved.

FIG. 3*b* shows a schematic top view on the cartridge 30, wherein the second 44*b* has been pushed towards the floater 16 such that the first portion engages, by way of non-limiting example, with the lever element 32 so as to artificially move the flag 22, i.e., the position of the flag 22 intermittently does not correspond with the filling level but allows to avoid sticking of the floater of the waste printing material. For example, a sensor element to sense the flag may be arranged so as to detect or evaluate the position of the flag 22 near a front end or homing position. At the rear homing position, the sensor element or a logic to evaluate the sensor element may ignore the information given by the flag as it knows about the artificial movement. Alternatively or in addition, the rear homing position may be out of range for the sensor element.

In other words, there is the possibility of the floater sticking to the waste, preventing it from floating. To avoid this effect, examples provide for a mechanism such that every time that the maintenance cartridge goes to the rear homing position, the floater is lifted off of the waste.

Figure 4:
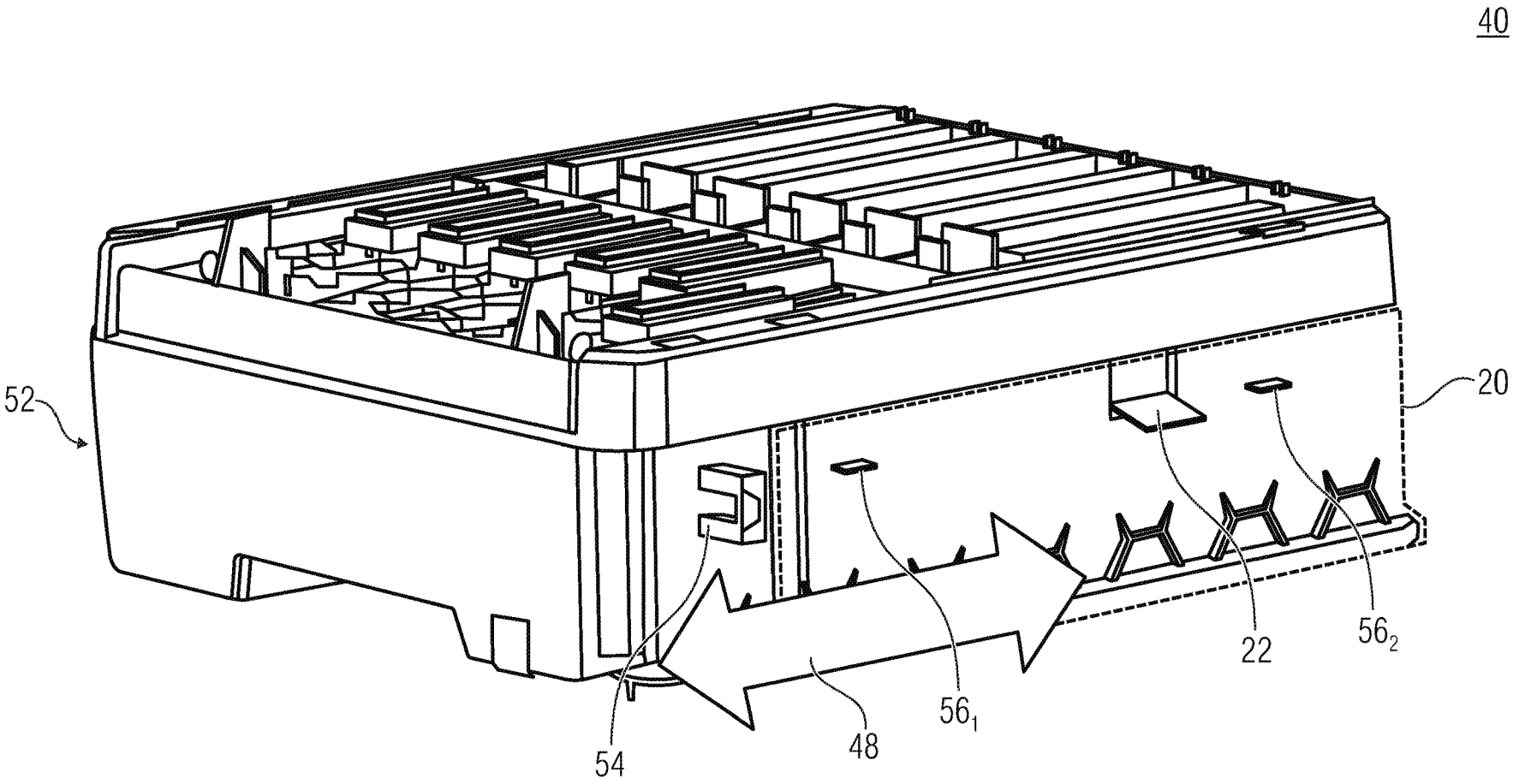
FIG. 4 shows a schematic perspective view of a printhead cleaning or maintenance system according to an example.

FIG. 4 shows a schematic perspective view of a printhead cleaning or maintenance system 40 according to an example. The printhead cleaning system 40 comprises a printing arrangement 52 to which a cartridge, e.g., the cartridge 20, is mounted so as to serve the printhead cleaning system 40 and/or so as to the home maintenance operation. The cartridge 20 may move along and against a cartridge movement direction 48, e.g., forward and back.

The printhead cleaning system 40 may comprise a sensor element 54 to detect the flag 22 outside the receptacle, the cartridge 20 respectively. The sensor element 54 may be arranged stationary, i.e., at the printing arrangement 52 and/or may be arranged at the cartridge 20, thereby moving with the cartridge 20. Arranging the sensor element 54 stationary with respect to the cartridge 20 allows the sensor element 54 to be synergistically used for detecting or monitoring the flag 22 and/or for determining a position of the cartridge 20 with respect to the printing arrangement 52, for example, by monitoring a position of flags $\mathbf{56}_1$ and/or $\mathbf{56}_2$ mounted to an outer surface of the cartridge 20. The flags $\mathbf{56}_1$ and/or $\mathbf{56}_2$ may thus indicate a position of the mobile servicing system in the printhead cleaning system 40 and may thus allow to prevent detecting the cartridge 20 to be at a homing position based on a motor current of a motor driving the cartridge 20. This may allow for precise and simple arrangements and determinations of the position of the cartridge 20.

The sensor element 54 may be of an electrical, a magnetic and/or an optical type. For example, the sensor element 54 may sense, measure or detect a magnetic field of a magnet attached to the cartridge 20. Alternatively or in addition, a capacitive and/or inductive sensor may be used. According to an example, the sensor element 54 may be implemented as an optical sensor that may monitor or detect a position of the flags $\mathbf{56}_1$ and/or $\mathbf{56}_2$.

The sensor element 54 may output a sensor signal indicating a degree of filling of the receptacle 14. For example, the sensor element 54 may output a sensor signal indicating that a degree of filling of the receptacle of the cartridge 20 is at least a filling threshold level. A single filling threshold level or a plurality thereof may be used, for example, allowing for different regions of filling such as empty, partially filled, almost full and/or full. The printhead cleaning system 40 may provide a signal indicating that the degree of filling is at least the filling threshold level. A signal may be provided, for example, to a user. This may be implemented, for example, as an optical, acoustic and/or electronic signal.

Although the printhead cleaning system 40 is described as comprising the cartridge 20, alternatively or in addition, the cartridges $\mathbf{10}_1$, $\mathbf{10}_2$, $\mathbf{10}_3$, $\mathbf{10}_4$ and/or 30 may be arranged.

Examples describe a floating flag to measure the waste level and/or to a lifter, i.e., mechanical actuator 44, to avoid the floater sticking to the waste. Examples allow for a continuous measure of the level with an optical sensor to detect the flag 22. Some of the subsystems of the printhead cleaning system 40 are fixed to the printer while others are mobile and can be replaced at the end of the live of a system. Examples described herein are especially useful in mobile components such as the cartridge. Such a mobile system may have one degree of freedom moving frontwards and rearwards. For doing the homing of the movement there may be fixed, digital optical sensor elements and the mobile part, e.g., the maintenance cartridge, may comprise flags 56 to indicate its position. Examples may use a fixed sensor element 54 to collect the signal of the waste level in addition to the position of the cartridge. The sensor element 54 may be implemented as a digital sensor, but the length of the flags may be different in size and/or length, so that it is possible to know which flag is sensed and/or to account for the distance moved by the maintenance cartridge with the optical sensor 54. The flag may float over the waste, rotating, making the flag 22 to protrude from the maintenance cartridge. This flag may be tapered, so that the sensor sees a different length depending on the degrees of rotation of the flag, allowing the printer to know the actual level of the waste.

To develop an analog measure of the waste level, a tapered flag may be used, so that as it rotates, the length increases. When moving the maintenance cartridge, the time which the flag blocks the optical sensor 54 may increase as the length of the flag 22 outside of the cartridge increases. This can be compared to a fixed length reference flag, such as flags 56. To characterize the system, the flag length can be measured with waste at different levels and a relation of waste level versus a length may be developed and stored in the printhead cleaning system 40.

Figure 5:
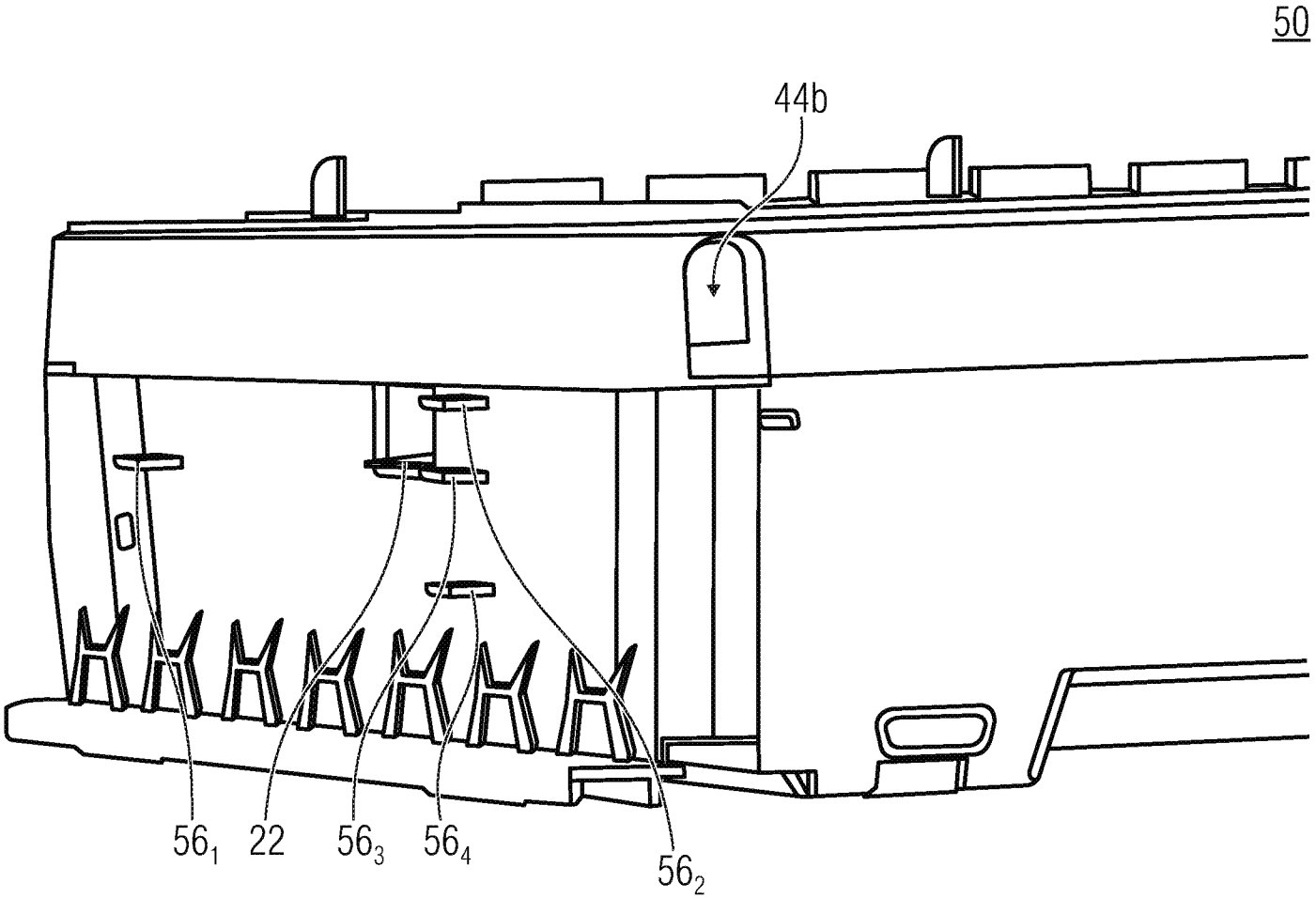
FIG. 5 shows a schematic perspective view of a printhead cleaning cartridge according to an example having a plurality of flags at an outer side of the cartridge and providing for a fixed reference length.

FIG. 5 shows a schematic perspective view of a printhead cleaning cartridge 50 according to an example that may be used in the printhead cleaning system 40. At an outer side of the printhead cleaning cartridge 50, there are mounted a plurality of flags $\mathbf{56}_1$ and/or $\mathbf{56}_4$ providing for a fixed reference length when compared to a length of the flag 22 outside of the printhead cleaning cartridge 50. The sensor element 54 of the printhead cleaning system 40 may compare the length of the flag 22 against the lengths of the flags $\mathbf{56}_1$ and/or $\mathbf{56}_4$ that may be the same or different when compared to each other.

Examples allow for directly measuring accumulated ink waste with low-cost concepts. Further, examples allow the system to avoid suffering from sticking effects of a level sensor due to contact with waste. Alternatively or in addition, examples may allow the system to have a continuous measure of the waste level using a simple optical sensor. Examples directly measure the waste with a floating flag. To avoid the floater sticking to the waste and becoming submerged, examples comprise a mechanical actuator to move the floater every now and then to avoid the gluing and the sticking. The floater floating off of the waste may cause it to rotate and this rotation can make a flag protrude from the maintenance cartridge. The shape of this flag may present the sensor with a different length depending on the degrees of rotation of the flag. This allows to know the level of the waste continuously. By knowing the level of the waste continuously, leakage of the waste in a servicing system may be prevented in a low-cost and direct way. The waste accumulation may be based on different factors such as a percentage of ink loss in aerosol during firing, a temperature, atmospheric pressure, humidity, movement of the waste and/or air flowing over the waste. Examples thus provide for a low-cost waste level sensor in servicing the mobile systems.

Figure 6A:
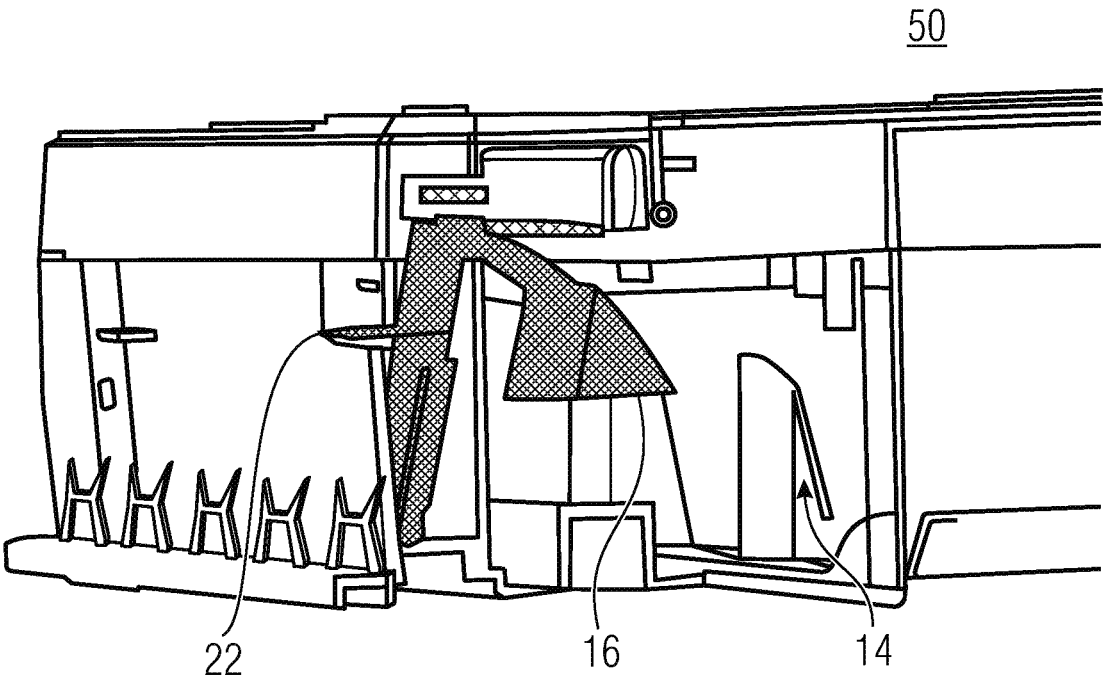
FIG. 6*a* shows a schematic perspective view of the printhead cleaning cartridge of FIG. 5 having an empty receptacle, leading the floater to have a low position.

FIG. 6*a* shows a schematic perspective view of the printhead cleaning cartridge 50 having an empty receptacle 14, leading the floater 16 to have a low position and/or deflect 22 to having a minimum size outside of the printhead cleaning cartridge 50 or even being arranged inside the printhead cleaning cartridge 50.

Figure 6B:
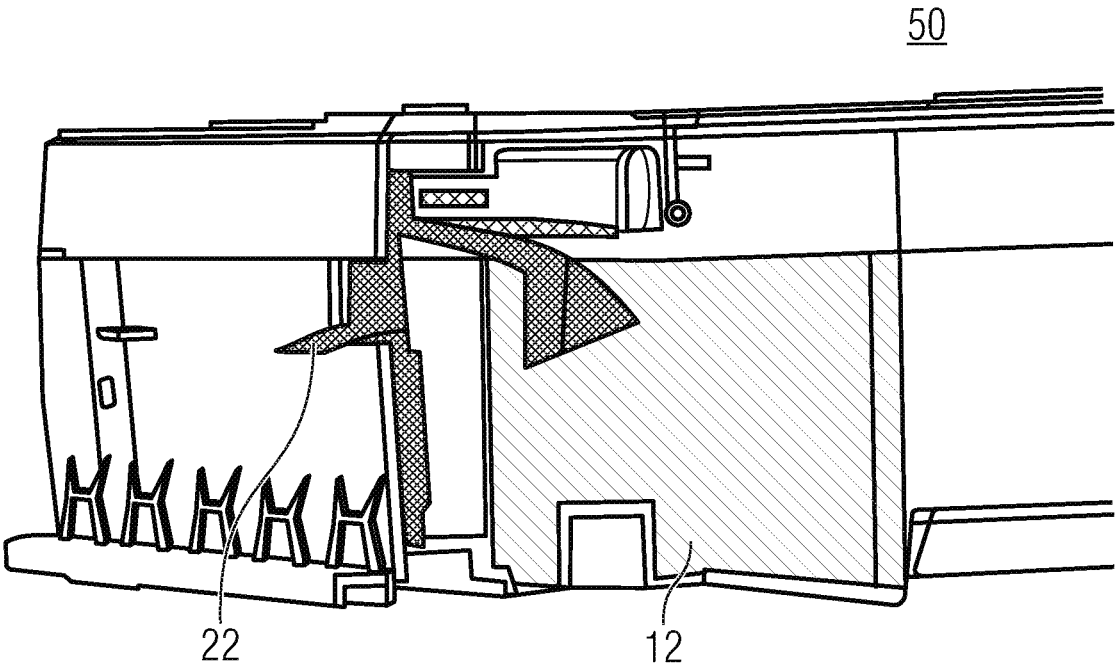
FIG. 6*b* shows a schematic perspective view of the printhead cleaning cartridge of FIG. 6*a* having the receptacle filled with the waste printing material.

FIG. 6*b* shows a schematic perspective view of the printhead cleaning cartridge 50 having the receptacle 14 filled with the waste printing material 12, leading the flag 22 to stick out of the printhead cleaning cartridge 50 at a maximum position and/or maximum size as the receptacle 14 is full with the waste printing material 12.

When referring again to the printhead cleaning or maintenance system 40 described in connection with FIG. 4 whilst still making reference to the explanations of FIG. 6*a* and FIG. 6*b*, in the following there is provided some example implementations of the flag 22 that may be used alternatively or in addition with the further examples described herein. Whilst making reference to FIG. 6*c*, FIG. 6*d* and FIG. 6*e*, there are described examples to support evaluation of the position of the flag 22 using the sensor element 54.

Figure 6E:
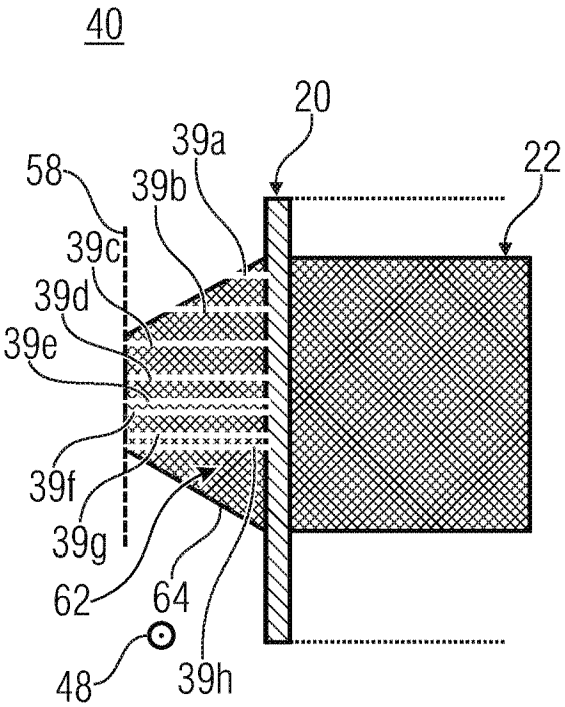
FIG. 6*e* shows a schematic side view of the part of the printhead cleaning system of FIG. 6*a*, the flag having structures thereon.
Figure 6D:
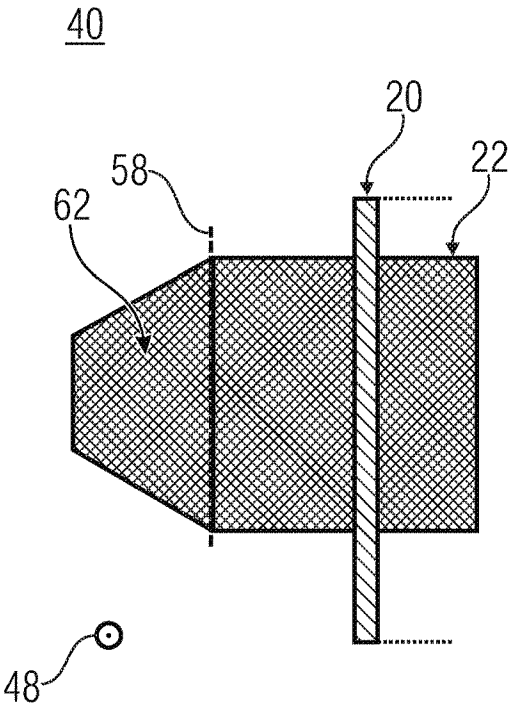
FIG. 6*d* shows a schematic side view of the part of the printhead cleaning system of FIG. 6*d* in a second condition leading the flag so as to outside the cartridge with an increased portion.
Figure 6C:
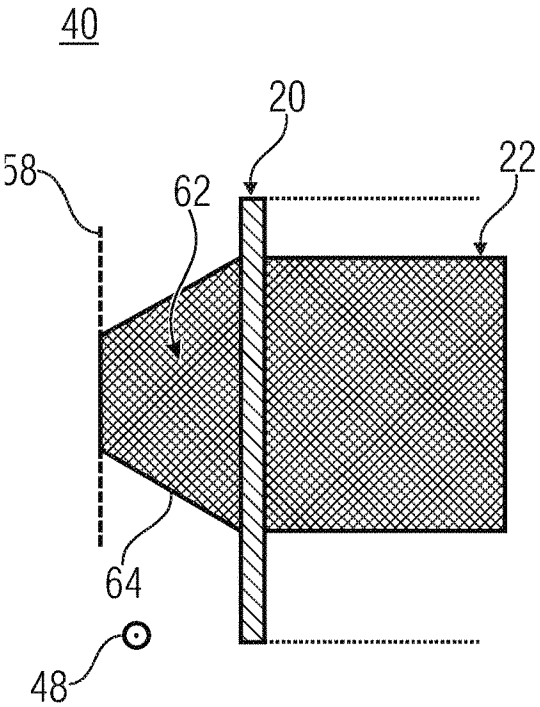
FIG. 6*c* shows a schematic side view of a part of the printhead cleaning system of FIG. 4 in a first condition leading the flag so as to be outside the cartridge with a small portion.

FIG. 6*c* shows a schematic side view of a part of the printhead cleaning system 40 in a first condition leading the flag 22 so as to be outside the cartridge 20 with a small portion. For example, this condition may indicate a state at the beginning of a lifetime of the cartridge 20 and/or may indicate a state "empty" of the receptacle. A line 58 may indicate a plane that is monitored or detected by the sensor element 54. The flag 22 may be oriented so as to face the sensor element 54 with a tapered side 62, e.g., perpendicular to the direction 48. Alternatively, the tapered side may also be arranged in parallel to the direction 48. According to an example, the maintenance cartridge 20 may be moved along the direction 48 such that the sensor element 54 detects the flag a specific time as the flag 22 approaches and is close enough.

FIG. 6*d* shows a schematic side view of the part of the printhead cleaning system 40 in a second condition leading the flag 22 so as to outside the cartridge 20 with an increased portion. For example, this condition may indicate a state at the end of a lifetime of the cartridge 20 and/or may indicate a state "full" of the receptacle. When the maintenance cartridge 20 moves in this condition, the sensor element indicated by the line 58 may detect the flag 22 for a longer time when compared to FIG. 6*c* before it is undetected based on the movement along direction 48 so as to have a distance that leads the flag 22 to be out of sight for the sensor element 54. The sensor element 54 may allow for evaluating a size of the flag 22, the size indicating the condition. Alternatively or in addition, the time interval for which the flag 22 is in sight for the sensor element 54 may be evaluated. Both the size and the time may be adapted based on the tapering of the flag 22 at a tapered portion 64. The printhead cleaning system 40 and/or printing system may be in communication with a processor, determining unit, central processing unit or the like that correlates the size of the flag or the determined time with the condition of the cartridge 20. For example, a database, lookup table or an equation may be used in connection with machine readable instructions so as to equate or correlate the time or flag length or flag size with the lifetime of the cartridge 20. For example, the flag 22 is detected for a longer, e.g., double, time when compared to the condition of FIG. 6*c*.

FIG. 6*e*. shows a schematic side view of the part of the printhead cleaning system 40 in the first condition. The flag comprises the structures 39*a* to 39*h*. Using the tapered portion 64, the length or size of the flag 22 may provide for a varying number of structures 39*a* to 39*h* to be detected with the sensor element 54 at the line 58 such that the number of structures 39*a* to 39*h* may alternatively or in addition to the size and/or the time be used to be correlated with the condition of the cartridge 20.

Although the flag 22 may be arranged or oriented so as to face the sensor element 54 with a thin side of the flag 22, see, for example, FIG. 4, this does not prevent the sensor element 54 to evaluate a broad side of the flag 22 that is possibly tapered and/or carries the structures 39*a* to 39*h*. When approaching the sensor element 54, the broad side of the flag 22 may be seen by the sensor element 54, e.g., using a different height between flag 22 and sensor element 54.

All of the features disclosed in the specification including any accompanying claims, abstract and drawings, and/or all the features of any method or progress described may be combined in any combination including any claim combination, except combinations where at least some of such features are mutually exclusive. In addition, features disclosed in connection with a system may, at the same time, present features of a corresponding method, and vice versa.

Each feature disclosed in the specification including any accompanying claims, abstract and drawings may be replaced by other features serving the same, equivalent or a similar purpose, unless expressly stated otherwise. Thus, unless expressly stated otherwise, each feature disclosed is one example of a generic series of equivalent or similar features.

The foregoing has described the principles, examples and modes of operation. However, the teaching herein are not be construed as being limited to the particular examples described. The above-described examples are to be regarded as illustrative rather than restrictive, and it is to be appreciated that variations may be made in those examples without departing from the scope of the following claims.

The invention claimed is:

1. A cartridge for a printing system, comprising:

a receptacle to receive waste printing material;

a floater to change its position based on a varying filling level of the waste printing material in the receptacle;

a flag mechanically coupled to the floater, wherein a position of the flag depends on the position of the floater and indicates, outside the receptacle, the filling level;

wherein the flag extends outside a housing of the cartridge and extends further from the cartridge as the floater rises to indicate more waste printing material in the receptacle.

2. The cartridge of claim 1, wherein the floater is to move along a first direction in the receptacle with an increase of the filling level, and wherein the flag is to extend laterally from a side of the cartridge.

3. The cartridge of claim 1, wherein the flag extends laterally from a side of the cartridge in a direction perpendicular to movement of the float.

4. The cartridge of claim 1, wherein the floater and the flag are mechanically coupled to each other via a lever element hinged at a bearing region so as to convert a movement of the floater along a first direction into a movement of the flag along a second direction by a rotation of the lever element at the bearing region.

5. The cartridge of claim 4, wherein the bearing region is inside the cartridge and outside the receptacle.

6. The cartridge of claim 1, wherein the flag comprises a tapered portion that widens from a tip, the tip being extended first from the housing of the cartridge when the flag is extended.

7. The cartridge of claim 1, wherein the floater is to have a floating position when floating on the waste printing material, the cartridge further comprising a mechanical actuator to mechanically lift the floater away from contact with the waste printing material.

8. The cartridge of claim 7, wherein the mechanical actuator is to intermittently mechanically engage with the floater or an element mechanically coupled thereto.

9. The cartridge of claim 8, comprising a spring element, wherein the mechanical actuator is to change the position of the floater in a first actuator position, the spring element to reset the mechanical actuator into a second actuator position in which the mechanically actuator does not change the position of the floater.

10. The cartridge of claim 7, wherein the mechanical actuator comprises a first portion to actuate the floater and a second portion mechanically coupled to the first portion and arranged outside the cartridge, wherein the second portion is to intermittently mechanically engage with a static portion of the printing system so as to move the first portion, thereby changing the position of the floater.

11. The cartridge of claim 10, wherein the second portion is to engage with the static portion at a homing position of the cartridge.

12. The cartridge of claim 1, wherein the flag comprises different colors or labeling to indicate different filling levels of the receptacle.

13. A printhead cleaning system for a printing system, comprising:

a printing arrangement to receive a replaceable printhead cleaning cartridge and move the cartridge forward and back;

the printhead cleaning cartridge having: a waste volume to collect waste printing material, a floater to change its position based on an amount of the waste printing material in the waste volume, and a flag mechanically coupled to the floater, wherein a position of the flag depends on the position of the floater and indicates, outside the cartridge, the amount of waste printing material;

a sensor element to detect the flag when extending outside the cartridge; and a mechanical actuator coupled to the floater, wherein movement of the cartridge actuates the mechanical actuator to lift the floater away from contact with waste printing material collected in the waste volume.

14. The printhead cleaning system of claim 13, wherein the sensor element is to output a sensor signal indicating that a degree of filling of the receptacle is at least a filling threshold level and to provide, to a user, a signal indicating that the degree of filling is at least a filling threshold level.

15. The printhead cleaning system of claim 13, wherein the sensor element is an optical sensor.

16. The printhead cleaning system of claim 13, wherein the sensor element is further to detect a position of the cartridge in the printing system.

17. The printhead cleaning system of claim 13, wherein the mechanical actuator is actuated each time the cartridge returns to a homing position.

18. The printhead cleaning unit of claim 13, wherein the mechanical actuator is biased by a spring which is compressed by movement of the cartridge into a homing position, the movement of the cartridge actuating the mechanical actuator to lift the floater to prevent the floater from sticking to the waste printing material.

19. The printhead cleaning unit of claim 13, wherein the flag is planar along its direction of motion.

20. The printhead cleaning unit of claim 13, wherein the cartridge comprises additional flags that extend therefrom by which the sensor determines a position of the cartridge.

* * * * *